US008867763B2

(12) United States Patent
Bouse

(10) Patent No.: US 8,867,763 B2
(45) Date of Patent: Oct. 21, 2014

(54) METHOD OF FOCUSING A HEARING INSTRUMENT BEAMFORMER

(71) Applicant: Siemens Medical Instruments Pte. Ltd., Singapore (SG)

(72) Inventor: Vaclav Bouse, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 0 days.

(21) Appl. No.: 13/911,247

(22) Filed: Jun. 6, 2013

(65) Prior Publication Data

US 2013/0329923 A1 Dec. 12, 2013

Related U.S. Application Data

(60) Provisional application No. 61/656,110, filed on Jun. 6, 2012.

(30) Foreign Application Priority Data

Aug. 8, 2012 (DE) ..... 10 2012 214 081

(51) Int. Cl.
*H04R 25/00* (2006.01)

(52) U.S. Cl.
CPC ..... *H04R 25/40* (2013.01); *H04R 25/407* (2013.01); *H04R 25/554* (2013.01); *H04R 25/552* (2013.01)
USPC ..... 381/313

(58) Field of Classification Search
CPC H04R 3/005; H04R 2430/23; H04S 2420/01; H04S 7/303
USPC ..... 381/313
See application file for complete search history.

(56) References Cited

U.S. PATENT DOCUMENTS

2002/0191799 A1 12/2002 Nordqvist et al.
2005/0094834 A1 5/2005 Chalupper (Continued)

FOREIGN PATENT DOCUMENTS

DE 10351509 A1 6/2005
DE 60120949 T2 7/2007

(Continued)

OTHER PUBLICATIONS

Peterson et al, "Multimicrophone adaptive beamforming for interference reduction in hearing aids" Research Laboratory of Electronics, Massachusetts Institute of Technology, Cambridge, Massachusetts 02139 Journal of Rehabilitation Research and Development, vol. 24 No. 4, pp. 103-110; 1987.

Siemens—BestSound Technology, "SpeechFocus", http://hearing.siemens.com/Global/en/professional-area/bestsound-technology/better-hearing/speech-intelligibility/speech-focus/speech-focus.html; 2012.

(Continued)

*Primary Examiner* — Brian Ensey
*Assistant Examiner* — Norman Yu
(74) *Attorney, Agent, or Firm* — Laurence A. Greenberg; Werner H. Stemer; Ralph E. Locher

(57) ABSTRACT

A beamformer of a hearing instrument is focused by automatically adapting the beam width and/or beam direction. A spatial orientation and/or position of the head of the hearing instrument user is first captured. When no head movements are captured, the acoustic signals are picked up with directional dependency. Then the amplification of acoustic signals is boosted that originate from a focus solid angle in front of the head of the hearing instrument user, compared with acoustic signals from other solid angles. This activates or increases directivity. Then the focus solid angle is decreased to gradually focus and to increase directivity, until the level of acoustic signals from the focus solid angle, actually the presence of the desired signals in the focus solid angle (purely theoretically the probability that the desired signal is present in the focus solid angle), reduces on account of reducing the focus solid angle.

12 Claims, 5 Drawing Sheets

(56) References Cited

U.S. PATENT DOCUMENTS

| | | | | |
|---|---|---|---|---|
| 2007/0223754 | A1 | 9/2007 | Roeck et al. | |
| 2008/0192968 | A1 | 8/2008 | Ho et al. | |
| 2010/0074460 | A1 | 3/2010 | Marzetta | |
| 2010/0158289 | A1 | 6/2010 | Beck et al. | |
| 2011/0103620 | A1 | 5/2011 | Strauss et al. | |
| 2012/0008790 | A1 | 1/2012 | Bouse | |
| 2012/0020503 | A1 | 1/2012 | Endo et al. | |
| 2013/0064404 | A1* | 3/2013 | Ridler et al. | 381/313 |
| 2013/0208896 | A1* | 8/2013 | Chatlani et al. | 381/17 |

FOREIGN PATENT DOCUMENTS

| | | | |
|---|---|---|---|
| DE | 102007005861 | B3 | 8/2008 |
| DE | 102010026381 | A1 | 1/2012 |

OTHER PUBLICATIONS

Sung-Hwan Han et al; "Adaptive Beamforming for Moving Array with 3-axis Electronic Compass in Hearing Aids"; The 13th IEEE International Symposium on Consumer Electronics (ISCE2009), pp. 22-25, 2009.

* cited by examiner

METHOD OF FOCUSING A HEARING INSTRUMENT BEAMFORMER

CROSS-REFERENCE TO RELATED APPLICATION

This application claims the priority, under 35 U.S.C. §119 (a), of German patent application No. DE 10 2012 214 081.6, filed Aug. 8, 2012; the application further claims the benefit, under 35 U.S.C. §119(e), of provisional application No. 61/656,110, filed Jun. 6, 2012; the prior applications are herewith incorporated by reference in their entirety.

BACKGROUND OF THE INVENTION

Field of the Invention

The invention lies in the field of hearing instruments and relates, more particularly, to a method for focusing a beamformer of a hearing instrument.

Hearing instruments can be embodied for instance as hearing devices to be worn on or in the ear. A hearing device is used to supply a hearing-impaired person with acoustic ambient signals, which are processed and amplified so as to compensate for or treat the respective hearing-impairment. It consists in principle of one or a number of input transducers, a signal processing unit, an amplification facility and an output transducer. The input transducer is generally a sound receiver, e.g. a microphone and/or an electromagnetic receiver, e.g. an induction coil. The output transducer is generally realized as an electroacoustic converter, e.g. a miniature loudspeaker, an electromechanical converter, e.g. a bone conduction receiver, or as a stimulation electrodes for cochlea stimulation purposes. It is also referred to as an earpiece or receiver. The output transducer generates output signals, which are routed to the ear of the patient and are to generate a hearing perception in patients. The amplifier is generally integrated in the signal processing unit. Power is supplied to the hearing device by means of a battery integrated into the hearing device housing. The essential components of a hearing device are generally arranged on a printed circuit board as a circuit carrier or connected thereto.

For hearing instrument users, it is extremely difficult to understand an individual speaker or to listen exclusively in one specific direction, particularly in problematic acoustic environments with a plurality of acoustic sources (for instance the so-called cocktail party scenario). In order to improve the targeted, focused hearing or also speech intelligibility, it is known to use so-called beamformers in hearing devices, so as to highlight the respective acoustic source, e.g. a speaker, by other noises being less amplified than the desired acoustic signal. The use of beamformers presupposes the presence of a directional microphone arrangement, which requires at least two microphones in a spatially separate arrangement. Two microphones on a single hearing instrument are already adequate to achieve a directional, in other words spatially directed sensitivity of the microphone arrangement. An extension of the directional ability in hearing instruments can be achieved in that the microphones of both hearing instruments of a binaural hearing system are combined to form a directional microphone arrangement. This presupposes a preferably wireless connection (wireless link, e2e=Ear-to-Ear) of the two hearing devices.

In hearing instruments with directional microphone arrangements and beamformers, there is the problem of defining the direction in which the beamformer is to be directed, as well as finding an optimal width, in other words an optimal opening angle, of the beam. In other words, the problem involves finding the spatial direction in which the directional microphone arrangement is to have the highest sensitivity, as well as finding the angle or opening angle, across which the sensitivity is to be increased. It is obvious that an improved directionality and sensitivity can be achieved such that the beam is directed onto the acoustic source of interest as accurately as possible and is focused as narrowly as possible.

Acoustic sources of interest may be above all speakers or speech signals, nevertheless a series of further possibilities also comes into consideration, for instance music or warning signals.

Published patent application Pub. No. US 2011/0103620 A1 describes a method for reproducing acoustic signals with a number of loudspeakers. Suitable filtering of the individual loudspeaker signals allows for a desired spatial reproduction characteristic to be set.

Published patent application Pub. No. US 2012/0020503 A1 describes a hearing device, which operates with a method for acoustic source separation. The spatial direction of an acoustic source is determined using a binaural microphone arrangement. An acoustic output signal which is dependent on the determined direction is then generated by means of a binaural receiver arrangement.

Published patent application Pub. No. US 2007/0223754 A1 describes a hearing device, which determines the spatial direction of acoustic signals. The acoustic environment is then classified on the basis of the determined spatial-acoustic information and the transfer characteristic of the signal processing is set as a function of the classification.

Published patent application Pub. No. US 2010/0074460 A1 describes a hearing device which determines the spatial direction of acoustic sources. A beamformer is then oriented toward a determined direction in order to focus on the relevant acoustic source. The spatial direction may inter alia be determined with the aid of the alignment of the head or the viewing direction of the user.

Published patent application Pub. No. US 2010/0158289 A1 describes a hearing device, which operates with a method for "blind source separation" of various acoustic sources. The user can select the various identified sources consecutively by actuating a switch.

A method is known from hearing devices by the company Siemens with the title SpeechFocus, in which the acoustic environment is automatically inspected according to speech portions. If speech portions are identified, their spatial direction is determined. The amplification of acoustic signals is then boosted from this direction by comparison with signals from other directions.

Using the known methods and apparatuses, the simplest possibility of beamforming consists in assuming that the desired source or the desired speaker is located in front of the hearing instrument user and that the beam is consequently to be directed frontally forwards, wherein the beam direction is changed on account of user head movements. Alternatively, the hearing instrument can direct the beam in a desired direction by means of an algorithm for processing the microphone signals irrespective of the orientation of the head, wherein the beam direction can be controlled for instance by means of a remote control. Disadvantageously the user can nevertheless not or barely hear sources outside of the beam and thus also not register them. Furthermore, it is less pleasant and less intuitive for the user to have to control the beam using remote control.

Alternatively, the hearing instrument can automatically analyze the direction of acoustic sources possibly of interest and automatically align the beam in this direction, such as for instance in the method Speechfocus by Siemens. This may nevertheless be confusing for the user, since the hearing instrument can automatically and possibly unexpectedly jump back and forth between different sources, without any influence from the user. Furthermore, a continuously adapting beamformer changes the binaural "cues" and in the process hampers the localization of the source of interest for the user or even renders it impossible.

Contrary to the beam direction, the beam width is usually naturally constant or can be manually adjusted by the user between various preset opening angles.

BRIEF SUMMARY OF THE INVENTION

It is accordingly an object of the invention to provide a method of focusing a hearing instrument beam former which overcomes the above-mentioned disadvantages of the heretofore-known devices and methods of this general type and which enables an automatic adaptation of the beam width and/or the beam direction, which can be easily and intuitively used, which prevents an unexpected focusing of the beam without any effort from the hearing instrument user and which enables the user also to become aware of acoustic sources outside of the beam in a simple and easily operable manner.

With the foregoing and other objects in view there is provided, in accordance with the invention, a method of focusing a beamformer of a hearing instrument that includes the following steps:

capturing the spatial orientation and/or position of the head of the hearing instrument user, i.e., capturing or detecting head movements;

when determining an absence of head movements, capturing acoustic signals as a function of the direction;

then boosting the amplification of acoustic signals, which come from a focus solid angle upstream of the head of the hearing instrument user, by comparison with acoustic signals from other solid angles, and as a result activating or increasing the directivity;

then gradually focusing by reducing the focus solid angle and as a result increasing the directivity until the level of acoustic signals from the focus solid angle, actually the presence of the desired signals in the focus solid angle (purely theoretically the probability that the desired signal is present in the focus solid angle), reduces on account of the reduction in the focus solid angle.

In this way directivity is a property of the beamformer which can be displayed as a measured value, which is all the higher, the more the beamformer is focused, in other words the smaller the solid angle of the beam. By increasing the directivity of a beamformer, for instance by increasing a parameter of the beamformer corresponding to the mentioned measured value, signals in the beam are more significantly amplified by comparison with signals outside thereof. The described method in this way controls the mentioned parameters of the beamformer.

As a result, the direction-dependent directional capture of acoustic signals is advantageously automatically started once the user looks in the direction of an acoustic source, for instance a speaker, no longer moves his/her head and then focuses for his part on the source, i.e. stares intently. For the detection of head movements, suitable tolerance values or threshold value, for instance at least 15° rotation, must be predetermined in order to distinguish between unintentional or irrelevant minimal head movements and relevant head movements. A manual resolution of the focusing, for instance by pressing a button on the hearing instrument or with the aid of a remote control, is not necessary, thereby significantly adding to practicability and user-friendliness when applying the method.

In accordance with an added feature of the invention, the method further comprises:

identifying an acoustic source in the focus solid angle with the aid of the acoustic signals from the focus solid angle, for instance by using a frequency or frequency spectrum criterion, a 4 Hz speech modulation detector, a Bayes detector or a hidden Marcov model detector, focusing until the presence of the acoustic signals of the acoustic sources reduces in the focus solid angle as a result of reducing the focus solid angle.

As a result of the focusing being controlled or ended with the aid of an identified acoustic source, the probability is increased that the method actually focuses in a targeted manner on a source of interest to the user and not on a focus solid angle set at random in a source-independent manner.

An advantageous embodiment of the novel method adds the following further method steps:

identifying an acoustic source in the focus solid angle with the aid of the acoustic signals from the focus solid angle, for instance by using a frequency or frequency spectrum criterion, a 4 Hz speech modulation detector, a Bayes detector or a hidden Markov model detector, determining the spatial direction, in which the acoustic source is disposed, and centering the focus solid angle in this direction.

The directional alignment of the focus solid angle orients the focus better toward the source of interest to the user. This then allows for a sharper focusing on account of a narrow focus solid angle and thus increases the directionality. The increase in the directionality in turn results in a further boost in the source signal of interest.

In accordance with an advantageous further embodiment of the invention, the method includes the following further steps:

subsequently capturing further acoustic signals which come from other solid angles than the focus solid angle, capturing further acoustic sources with the aid of the further acoustic signals, for instance by using a frequency or frequency spectrum criterion, a 4 Hz speech modulation detector, a Bayes detector, or a hidden Markov model detector, when capturing a further acoustic source, boosting the amplification of the further acoustic signals, capturing the spatial orientation and/or position of the head of the hearing instrument user after boosting the amplification of the further acoustic signals, when capturing the absence of head movements within a predetermined period of time after boosting the amplification of the further acoustic signals, further reducing the amplification, when capturing a head movement within the predetermined period of time, defocusing by re-enlarging the focus solid angle and then implementing the method as claimed in one of the preceding claims.

As a result, while the method is in the stage which focuses on a source, while only the signals of this source are called up for the perception of the user, the further space around the user is scanned for further, incoming sources. If such a further source is found, and is made perceivable to the user by boosting the amplification, the user is so to speak referred to the presence of further sources. If the user responds by moving or turning his/her head, the previous focus is automatically cancelled and a re-focusing takes place. Advantageously the re-focusing is also automatically started and does not need to be manually triggered, thereby adding to the practicability and user-friendliness when applying the method.

A further advantageous embodiment of the novel method includes the further method steps:

in the absence of capturing further acoustic sources, capturing the spatial orientation and/or position of the head of the hearing instrument user; and when capturing a head movement, defocusing by re-enlarging the focus solid angle or by replacing direction-dependent with direction-independent capturing of acoustic signals.

As a result, the focusing is automatically ended once the user turns away from the source actually being focused, thereby further adding to the practicability and user-friendliness when applying the method.

A further advantageous embodiment consists in that the method is only then implemented if a head movement was captured prior to capturing the absence of head movements. This thus prevents an automatic focusing from being used for instance, although the user has not faced any acoustic source, for instance because it is a non-acoustic source or because the user does not wish to dedicate his/her increased attention to one source.

A further advantageous embodiment consists in the method only then being implemented if an acoustic source was captured in the focus solid angle prior to the focusing. This thus prevents focusing in the absence of acoustic sources, which would naturally not be meaningful.

Other features which are considered as characteristic for the invention are set forth in the appended claims.

Although the invention is illustrated and described herein as embodied in a method for focusing a hearing instrument beam former, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE INVENTION

Figure 1:
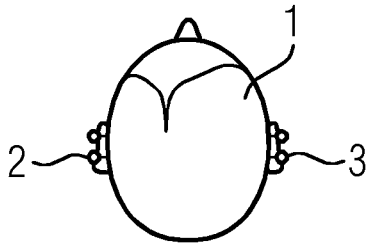
FIG. 1 is a plan view onto a user with a left and right hearing instrument.

Referring now to the figures of the drawing in detail and first, particularly, to FIG. 1 thereof, there is shown a schematic representation of a user 1 with a left hearing instrument 2 and a right hearing instrument 3 in a top view. The microphones of the left and right hearing instrument 2, 3 are combined in each instance to form a directional microphone arrangement, so that it is possible to direct the respective beam essentially either forwards or backwards from the perspective of the user 1. There is a further possibility of connecting the left and right hearing instrument 2, 3 with a wireless link (e2e) so as to enable a binaural configuration with binaural microphone arrangement. Directions from the perspective of the user 1 to the right and the left are thus substantially enabled as further beam directions of the arrangement. The automatic focusing of the beam can take place both individually for each monaural hearing instrument (front/rear) and also mutually for the binaural arrangement (right/left).

Figure 2:
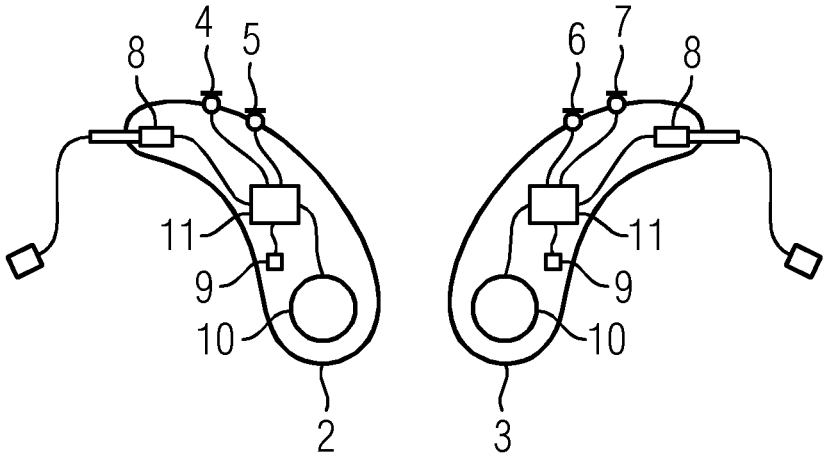
FIG. 2 is a view of a hearing instrument, with left and right devices, including essential components.

FIG. 2 schematically represents the left and right hearing instrument 2, 3 and the significant signal processing components. The hearing instruments 2, 3 are structured identically and differ possibly in terms of their outer shape, to accommodate for respective use on the left or right ear. The left hearing instrument 2 includes two microphones 4, 5, which are arranged spatially separate from one another and together form a directional microphone arrangement. The signals of the microphones 4, 5 are processed by a signal processing unit (SPU) 11, which outputs an output signal via the receiver 8. A battery 10 is used to supply power to the hearing instrument 2. In addition, a motion sensor 9 is provided, the function of which in the automatic focusing is to be explained in more detail below. The right hearing instrument 3 includes the microphones 6, 7, which are likewise combined to form a directional microphone arrangement. In respect of the further components, reference is made to the preceding description.

Figure 3:
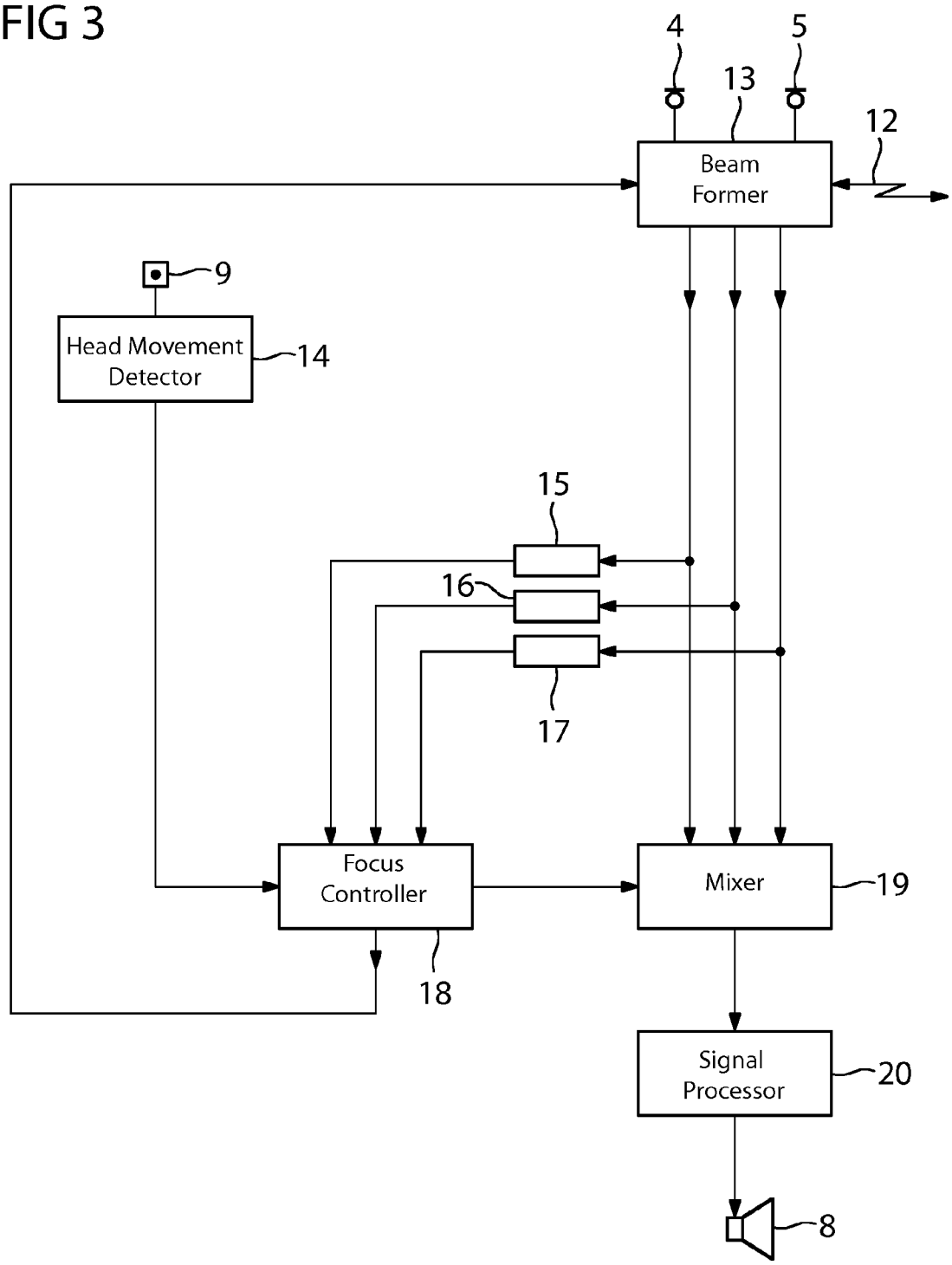
FIG. 3 shows signal processing components of the adaptive beamformer.

FIG. 3 schematically represents the essential signal processing components of the automatically focusing beamformer. The signals of the microphones 4, 5 of the left hearing instrument 2 are processed by the beamformer, such that, from the perspective of the user, a beam directed forwards is produced (0°, "Broadside"), which comprises a variable beam width. The variable beam width is equivalent to a variable directionality (smaller beam width indicates higher directionality and vice versa, wherein higher directionality is equivalent to larger directional dependency). The beamformer is structured in a conventional manner, for instance as an arrangement of fixed beamformers, as a mixture of a fixed beamformer with a direction-dependent Omni signal, as a beamformer with a variable beam width, etc.

Output signals of the beamformer 13 are the desired beam signal, which contains all acoustic signals from the direction of the beam, the direction-dependent Omni-signal (which contains all acoustic sources in all directions with undistorted binaural cues) and the anti-signal, which contains all acoustic signals from directions outside of the beam.

The three signals are fed to the mixer 19 and in parallel to the source detectors 15, 16, 17. The source detectors 15, 16, 17 continuously determine the probability (or a comparable measure) therefrom that an acoustic source of interest, for instance a speech source, exists in the three signals.

The motion sensor 9 has the task of capturing head movements of the hearing instrument user, for instance also rotation, and also determining a measure of the width of the respective movement. A dedicated hardware sensor of a conventional type is the quickest and most reliable possibility of detecting head movements. Nevertheless, other possibilities of detecting head movements are likewise available for instance based on a spatial analysis of the acoustic signals, or using additional alternative sensor systems. A head movement detector 14 analyses the signals of the motion sensor 9 and therefrom determines the direction and measure of head movements.

All signals are fed to the focus controller 18, which determines the beam width as a function of the signals. The determined beam width is fed to the beamformer 13 as an input signal by the focus controller 18. In addition to the beam width, the focus controller also controls the mixer 19, which mixes the three signals (Omni, Anti, Beam) explained above and forwards them to a hearing instrument signal processing unit 20. The acoustic signals are processed in the hearing instrument signal processing 20 in the manner which is usual for hearing instruments and output to the receiver 8 in an amplified manner. The receiver 8 generates the acoustic output signal for the hearing instrument user.

The focus controller 18 is preferably embodied as a finite-state machine (FSM), the finite states of which are to be explained in more detail below.

The three signals (Omni, Anti, Beam) are mixed by the mixer 19 such that the user receives a naturally sounding spatial signal. This also means that no abrupt transitions take place but instead soft transitions. The further processing steps take place in the hearing instrument signal processing 20, which are used in particular to compensate for or treat a hearing impairment of the user.

Figure 4:
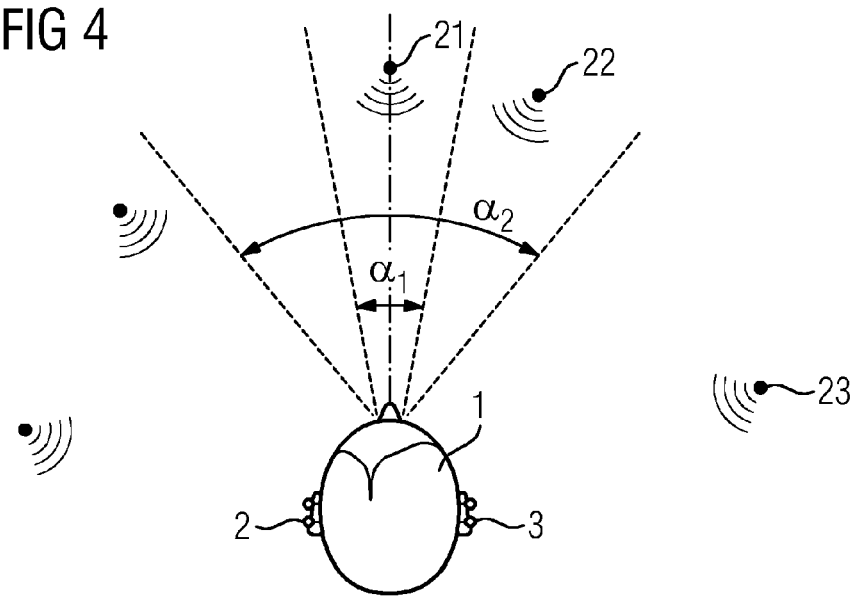
FIG. 4 shows a user and a number of acoustic sources.

FIG. 4 shows a schematic representation of an exemplary situation. A top view of the hearing instrument user 1 is shown with a left and right hearing instrument 2, 3. An acoustic source 21, in the direction of which the user 1 looks, is located in front of the user 1. The beam of the respective hearing instrument 2, 3 is focused on the acoustic source 21, in which the beam width was reduced to the angle $\alpha 1$. The further acoustic source 22 therefore lies outside of the beam, but would however lie inside of a beam with the beam width $\alpha 2$. The further acoustic source 23 still lies outside of the beam and is almost adjacent to the user 1.

Figure 5:
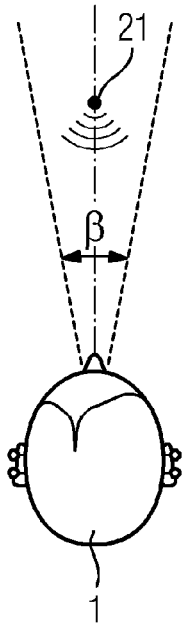
FIG. 5 shows a focused beam.
Figure 6:
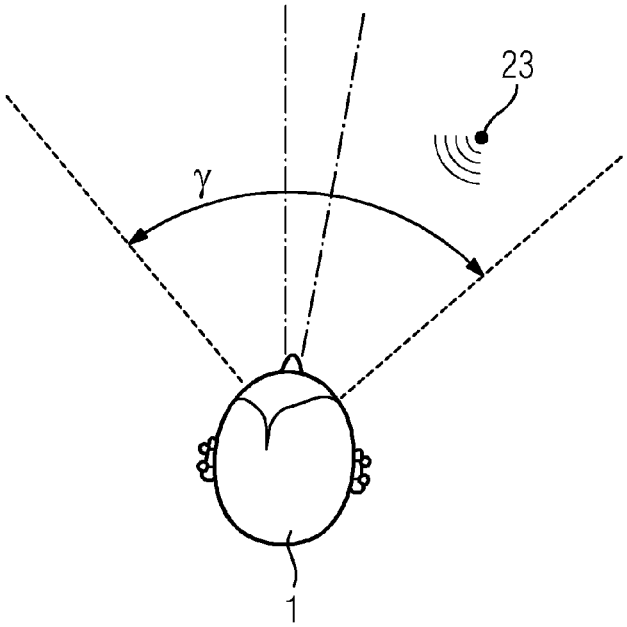
FIG. 6 shows acoustic sources outside of the beam.

FIGS. 5 to 8 schematically explain the functionality of the automatic focusing of the beam. In FIG. 5 the beam with the width $\beta$ is focused on the acoustic source 21. In FIG. 6 the user moves his/her head away from the source 21 and toward the source 23. The head movement is detected by the automatic focus controller (or by the motion sensor). The automatic focus controller thereupon defocuses the beam by converting to the signal Omni. This can as a result optionally also be defocused such that the beam width is set to a predetermined, significantly larger opening angle than in the focused state.

Figure 7:
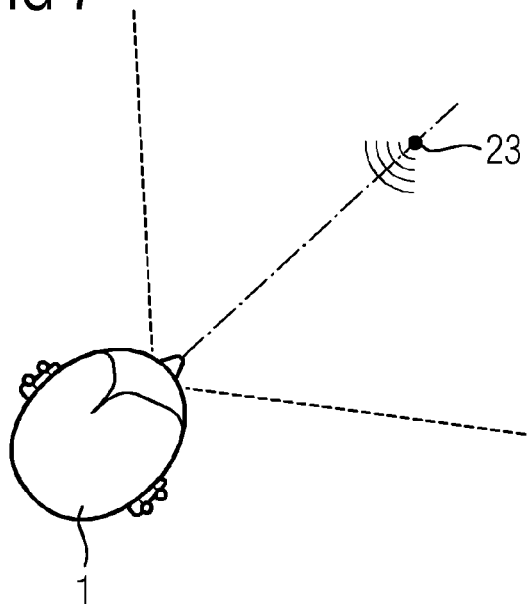
FIG. 7 shows the changing of the beam direction.
Figure 8:
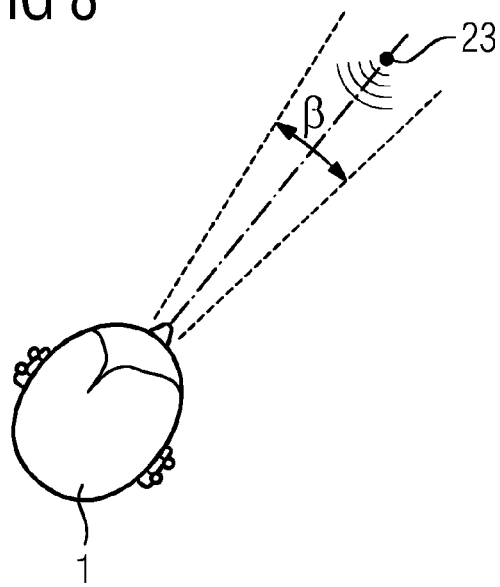
FIG. 8 shows a re-focused beam.

In FIG. 7, the user 1 has completely turned his/her head toward the acoustic source 23. The head movement ends and the user 1 looks at the source 23. The end of the head movement is detected, whereupon the automatic focusing of the beam toward the source 23 begins. In this way a change is if necessary made from the direction-independent Omni signal to the direction-dependent beam signal and/or the significantly increased beam width is gradually reduced. The beam width is reduced until the signal source 23 is completely focused. Further reduction of the beam width results in the source no longer lying completely inside the beam, so that the signal of the source 23 or its portion in the beam signal reduces. The focusing of the beam, i.e. the reduction in the opening angle of the beam, is ended as soon as the source 23 is focused sharply, as is the case in the angle $\beta$ plotted in FIG. 8. One possible further reduction in the beam angle is made reversible.

Figure 9:
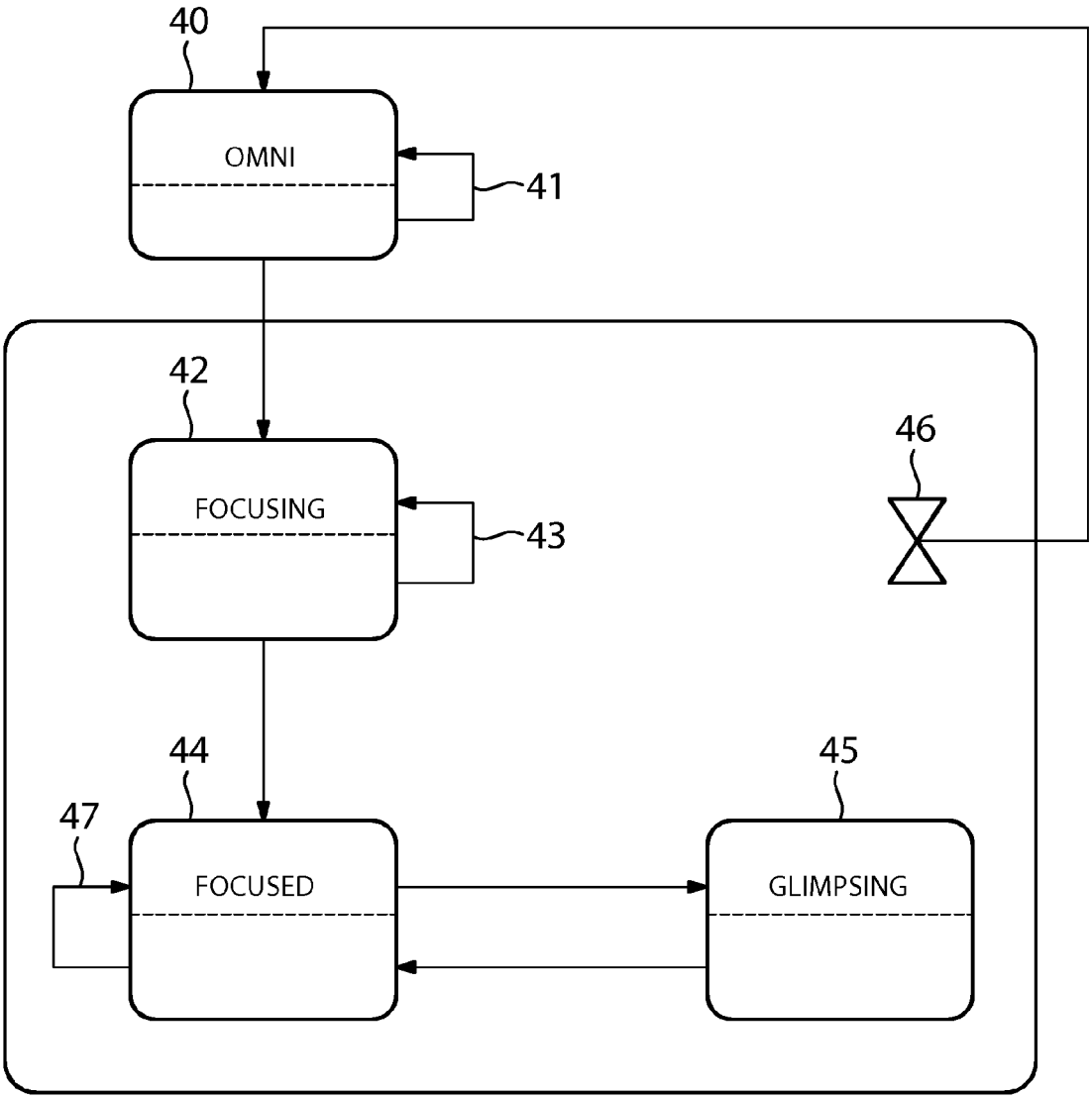
FIG. 9 shows a flow diagram, focusing and D-focusing.

FIG. 9 shows the finite states of the finite state machine (FSM). The FSM starts in the state "Omni" 40 (no directionality, the mixer outputs the signal Omni), by the hearing instrument user hearing in a normal and directionally-independent manner. In this state he/she is able to localize acoustic sources normally. He/she can move and rotate his/her head in a normal and natural manner, so as to search for an acoustic source of interest for instance, such as a speaker.

As soon as the user turns his/her attention to a source and concentrates on this source, he/she turns his/her head in the direction of this source and then no longer moves his/her head. The loop 41 is left. Instead, the FSM passes into the state "focusing" 42 and the directionality of the beamformer is gradually increased (i.e., the beam width is reduced and a correspondingly strong direction-dependent signal is output to the user). The portion of the signal of the source therefore grows in the beam signal and the mixer forwards the signal filtered in this way by exclusively or mainly outputting the signal beam.

As soon as the maximum directionality (minimal beam width) is reached, which corresponds to the state described above in FIGS. 5 and 8, the portion of the source signal of interest cannot be further increased in the beam signal. The directionality is not further changed (beam width not further reduced) and the FSM leaves the loop 43 and changes into the state "focused" 44. In the state "focused", the automatic beam controller continuously monitors head movements of the user (loop 47) with the aid of the motion sensor. Provided no head movements are detected, the FSM remains in the state "focused" 44.

It is further continuously monitored whether acoustic sources possibly of interest are present in the signals Omni and Anti outside of the beam. If a new source is discovered, the FSM changes into the state "glimpsing" 45. In the state "glimpsing" 45, a low portion of the Omni signal, which contains the possible further source, is mixed by the mixer into the output signal for the user. As a result, the user registers that a further source is available. If the user does not turn to face this new source, he/she does not move his/her head. The automatic focus controller determines this with the aid of the motion sensor and controls the portion of the Omni signal after a specific period of time back to zero (fade out) so that the user can once again concentrate completely on the focused signal. The described "glimpsing" state will be implemented each time a new source immerses in the acoustic environment or if the acoustic environment changes significantly.

If the user moves his/her head, because he/she wants to focus on a new signal or wants to get an easy overview of the acoustic environment, which is shown in the preceding FIG. 6, the head movement is detected and the focus controller immediately switches to the Omni signal, i.e. the beam width is enlarged again and/or the mixer additionally or exclusively outputs the Omni signal. This is reproduced in the Figure by element 46.

The Omni signal provides the user with an overview of the acoustic environment with all undistorted spatial cues, which are distorted in the beam signal or are missing. This allows the user to localize acoustic sources normally. As soon as the user concentrates on another acoustic source, which corresponds to the previously explained FIG. 7, the FSM once again transfers into the state focusing 42. The beam focusing therefore starts again.

It is clear that all states both of the beam focusing and also of the mixture are gently changed without sudden steps for a pleasant acoustic perception of the user.

By combining the different beamformer signals with the head movement detector, the afore-cited method provides for a function which is closely linked with the human way in terms of concentrating on different sources. In this way the head movement is used in order to use a natural feedback for the automatic focusing and rapid defocusing on a target, in order to control the beamformer. The focusing takes place gradually if the user does not move his/her head. The defocusing with head movement or the transition from the beam signal into the Omni signal takes place quickly, so as to have an undistorted signal with all spatial information rapidly available in the event of changes. The function of glimpsing allows the user to remain concentrated on the one hand on a source, and on the other hand nevertheless to retain an overview of new sources and changes.

A underlying concept and idea behind the invention may be summarized as follows: the invention relates to a method for focusing a beamformer of a hearing instrument. The object of the invention consists in enabling an automatic adaptation of the beam width and/or beam direction, which can be used in a user-friendly and intuitive manner. A basic idea behind the invention consists in a method for focusing a beamformer of a hearing instrument including the steps:

capturing the spatial orienting and/or position of the head of the hearing instrument user, when capturing the absence of head movements, capturing acoustic signals in a direction-dependent manner, then boosting the amplification of acoustic signals, which come from a focus solid angle in front of the head of the hearing instrument user, compared with acoustic signals from other solid angles and as a result activating or increasing the directivity, then gradually focusing by reducing the focus solid angle and as a result increasing the directivity until the level of acoustic signals from the focus solid angle, actually the presence of the desired signals in the focus solid angle (purely theoretically the probability that the desired signal is present in the focus solid angle), reduces on account of the reduction in the focus solid angle.

As a result, the direction-dependent, direction capture of acoustic signals is advantageously automatically started as soon as the user looks in the direction of an acoustic source, for instance a speaker, and then stares at the source intently.

The invention claimed is:

1. A method of focusing a beamformer of a hearing instrument, the method which comprises:

detecting head movements of a head of a hearing instrument user wearing the hearing instrument;

upon determining an absence of head movements, capturing acoustic signals in a direction-dependent manner;

subsequently boosting an amplification of acoustic signals that originate from a focus solid angle in front of the head of the hearing instrument user as compared with acoustic signals originating from other solid angles; and then gradually focusing by reducing the focus solid angle until a presence of desired acoustic signals originating from the focus solid angle decreases on account of reducing the focus solid angle.

2. The method according to claim 1, which further comprises identifying an acoustic source in the focus solid angle with the aid of the acoustic signals from the focus solid angle.

3. The method according to claim 2, wherein the identifying step comprises using a frequency or frequency spectrum criterion, a 4 Hz speech modulation detector, a Bayes detector or a hidden Markov model detector.

4. The method according to claim 2, which further comprises focusing until a presence of acoustic signals of the acoustic source in the focus solid angle decreases on account of reducing the focus solid angle.

5. The method according to claim 2, which comprises determining a spatial direction at which the acoustic source is disposed and centering the focus spatial angle in the direction of the acoustic source.

6. The method according to claim 1, which further comprises:

subsequently capturing further acoustic signals originating from other solid angles than the focus solid angle; and capturing further acoustic sources with the aid of the further acoustic signals.

7. The method according to claim 6, wherein the step of capturing the further acoustic sources comprises using a frequency or frequency spectrum criterion, a 4 Hz speech modulation detector, a Bayes detector or a hidden Markov model detector.

8. The method according to claim 6, which further comprises:

when capturing a further acoustic source, boosting an amplification of the further acoustic signals;

capturing the spatial orientation and/or position of the head of the hearing instrument user after boosting the amplification of the further acoustic signals;

when determining the absence of head movements for a predetermined duration after boosting the amplification of the further acoustic signals, re-reducing the amplification; and when capturing a head movement within the predetermined period of time, defocusing by re-enlarging the focus solid angle and then implementing the method steps according to claim 1.

9. The method according to claim 6, which further comprises:

when omitting the capture of further acoustic sources, capturing the spatial orientation and/or position of the head of the hearing instrument user; and when capturing a head movement, defocusing by re-enlarging the focus solid angle or by replacing a direction-dependent capture of acoustic signals with a direction-independent capture of acoustic signals.

10. The method according to claim 1, which comprises implementing the method only after a head movement was captured prior to capturing an omission of head movements.

11. The method according to claim 1, which comprises implementing the method only after an acoustic source is captured in the focus solid angle prior to focusing.

12. The method according to claim 1, which comprises executing the method steps in a hearing instrument.

* * * * *